US011749475B2

(12) United States Patent
Rodriguez et al.

(10) Patent No.: US 11,749,475 B2
(45) Date of Patent: Sep. 5, 2023

(54) ARC CHUTE DEBRIS BLOCKER

(71) Applicant: EATON INTELLIGENT POWER LIMITED, Dublin (IE)

(72) Inventors: Alexis Rodriguez Rodriguez, Santo Domingo (DO); Guaroa De Jesus Vasquez Ortiz, Santo Domingo (DO); Rolando Sthanison Mata Mordan, Santo Domingo Este (DO)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/524,835

(22) Filed: Nov. 12, 2021

(65) Prior Publication Data

US 2023/0154704 A1 May 18, 2023

(51) Int. Cl.
*H01H 33/08* (2006.01)
*H01H 33/42* (2006.01)

(52) U.S. Cl.
CPC ..... *H01H 33/08* (2013.01); *H01H 33/42* (2013.01)

(58) Field of Classification Search
CPC ..... H01H 33/08; H01H 33/06; H01H 33/42; H01H 2033/085; H01H 9/32; H01H 9/34; H01H 9/345; H01H 9/346; H01H 9/36; H01H 9/362; H01H 2009/365; H01H 2009/367; H01H 2009/348; H01H 71/0207
USPC ... 218/149, 34, 41, 46, 81, 151, 156, 26, 38
See application file for complete search history.

(56) References Cited

U.S. PATENT DOCUMENTS

| | | | | |
|---|---|---|---|---|
| 2,244,061 | A | 6/1941 | Graves, Jr. | |
| 2,468,422 | A | 4/1949 | Wood | |
| 6,248,970 | B1 * | 6/2001 | DiMarco | H01H 9/34 218/15 |
| 7,186,941 | B2 * | 3/2007 | Yeon | H01H 9/346 218/15 |
| 8,237,074 | B2 * | 8/2012 | Tetik | H01H 9/362 218/156 |

(Continued)

FOREIGN PATENT DOCUMENTS

WO 01/39224 A1 5/2001

OTHER PUBLICATIONS

European Patent Office, "extended European search report", for corresponding European Patent Application No. 22206014.7, dated Apr. 5, 2023, 8 pp.

*Primary Examiner* — William A Bolton
(74) *Attorney, Agent, or Firm* — Eckert Seamans Cherin & Mellott, LLC

(57) ABSTRACT

An arc chute assembly includes a first arc side and a second arc side opposite and spaced apart from the first arc side, each arc side including a first vertical edge, a second vertical edge, and a debris blocker component at the second vertical edge, where the debris blocker component is disposed proximate to the separable contacts and structured to contain debris generated during an interruption; and a plurality of arc plates disposed between the arc sides, the separable contacts disposed within the plurality of arc plates, each arc plate including a base and two legs each extending from the base and comprising a distal element proximate to the separable contacts, where each arc plate is structured to attract and quench an arc generated upon opening of the separable contacts associated with the interruption and the distal element is structured to accelerate the opening of the separable contacts.

14 Claims, 10 Drawing Sheets

(56) References Cited

U.S. PATENT DOCUMENTS

| | | | | |
|---|---|---|---|---|
| 9,530,592 | B1 * | 12/2016 | Blankemeyer | H01H 33/08 |
| 9,704,676 | B1 * | 7/2017 | Cardwell | H01H 9/362 |
| 10,128,069 | B1 * | 11/2018 | Ruempler | H01H 33/08 |
| 10,840,047 | B2 * | 11/2020 | Oh | H01H 9/32 |
| 2006/0086693 | A1 | 4/2006 | Yeon | |
| 2013/0284702 | A1 | 10/2013 | Hamada et al. | |
| 2015/0348720 | A1 * | 12/2015 | Smeltzer | H01H 9/34 218/151 |
| 2017/0301500 | A1 * | 10/2017 | Stifter, Jr. | H01H 71/46 |
| 2017/0358403 | A1 * | 12/2017 | Zhou | H01H 33/596 |

* cited by examiner

ARC CHUTE DEBRIS BLOCKER

FIELD OF THE INVENTION

The disclosed concept relates generally to electrical switching apparatus. The disclosed concept also pertains to arc chute assemblies integrating a debris blocker and a slot motor as a single device for electrical switching apparatus.

BACKGROUND OF THE INVENTION

Circuit interrupters, such as for example and without limitation, circuit breakers, are typically used to protect electrical circuitry from damage due to an overcurrent condition, such as an overload condition, a short circuit, or another fault condition, such as an arc fault or a ground fault.

Circuit breakers, for example, typically include a set of stationary electrical contacts and a set of movable electrical contacts in arc chamber. The stationary and movable electrical contacts are in physical and electrical contact with one another when it is desired that the circuit breaker energize a power circuit. When it is desired to interrupt the power circuit, the movable contact and stationary contact are separated. These separable contacts generate an electric arc in the space between the contacts when they are tripped open as a consequence of an electrical fault. The arc provides a means for smoothly transitioning from a closed circuit to an open circuit, but produces a number of challenges to the circuit breaker designer. Among them is the fact that the arc results in the undesirable flow of electrical current through the circuit breaker to the load when it is desired to isolate the load from such current. Additionally, the arc, which extends between the contacts, often results in vaporization or sublimation of the contact material itself. Therefore, it is desirable to extinguish any such arcs as soon as possible upon their propagation.

To facilitate this process, the circuit breakers typically include components to enclose and extinguish the arc as shown in FIGS. 2A-B and 5A. These components include arc chute assemblies 2100, debris blocker 2130, and a slot motor 2140. The arc chute assemblies 2100 are intended to contain the electric arc generated by the electric fault by attracting and breaking the arc, and include arc plates 2110 and arc sides 2120. As the movable contact 2201 is moved away from the stationary contact 2203, the movable contact 2201 moves past the ends of the arc plates 2110, with the arc being magnetically drawn toward and between the arc plates 2110. The arc chute assemblies 2100 and, in particular, the arc plates 2110 of the arc chute assemblies 2100 are designed to encourage the arc to enter the arc plates 2110. The arc transfers to the arc plates 2110 where it is stretched and cooled until extinguished. The arc plates 2110 are electrically insulated from one another such that the arc is broken-up and extinguished by the arc plates 2110.

While the arc chute assemblies 2100 are containing and quenching the electric arc generated by the electric fault, they suffer some erosion, which generate debris in the form of metallic pellets and carbon dusts. Such debris is projected out of the arc chamber 2102 and into the operating mechanism area O' and tends to wedge in the moving components causing the operating mechanism to malfunction. The debris blocker 2130 is structured to deflect or contain the debris formed during interruption. However, the debris blocker 2130 typically includes two side walls 2131 by the sides of the moving arm 2202 as shown in FIG. 5A. The two side walls 2131 are typically merely flat surfaces, and thus the debris can bounce off the walls 2131 and still fall into the operating mechanism area O' as shown by the debris path B, resulting in malfunction of the moving components therein.

The slot motor 2140 is typically provided to speed the separation of the movable contact 2200 from the stationary contact 2203 in the event of a fault involving a high current discharge, for example, up to 25 kA. The slot motor 2140 may be made of magnetically permeable materials (e.g., steel) in a ring, loop, or U-shape within which the separable contacts 2200, the moving arm 2202 and the stationary arm 2204 are disposed. When an arc is drawn between the separable contacts 2200 during the separation, the electrical current interacts electromagnetically with the slot motor 2130 to induce a magnetic field in the magnetic material of the slot motor 2140, which then accelerates the separation of the separable contacts 2200.

However, due to the limited space within the arc chamber 2102, inserting the arc chute assemblies 2100, debris blocker 2130 and slot motor 2140 in the arc chamber 2102 as separate components faces additional challenges. Further, the arc chute assembly 2100, the slot motor 2140, and the debris blocker 2130 are typically press-fit and held together with each other. As such, they require specific alignment, placement and dimensional stability to provide arc suppression and debris containment. Any variation from the specified alignment, placement, and dimensional stability reduce their functionalities and efficiencies, leading to, at time, hazardous situations. For example, in the event of interruption or arc, they may be shaken or moved, resulting in disconnections from one another or other components attached thereto. Such disconnections allow, for example, debris to find additional paths to enter into the operating mechanism area O'.

There is room for improvement in arc chute mechanism in circuit interrupters.

There is room for improvement in debris containment in circuit interrupters.

There is room for improvement in magnetic enhancement in circuit interrupters.

SUMMARY OF THE INVENTION

These needs, and others, are met by a circuit interrupter structured to electrically connect between a power source coupled to a hot conductor and a load. The circuit interrupter includes separable contacts; an operating mechanism coupled to the separable contacts and structured to open and close the separable contacts; an electronic trip unit coupled to the operating mechanism and a current sensor, the electronic trip unit structured to cause the operating mechanism to open the separable contacts and interrupt current flowing through the circuit interrupter based at least in part on a signal indicative of a detected fault received from the current sensor; and an arc chute assembly disposed between a hot conductor terminal and an operating mechanism area, including a first arc side and a second arc side opposite and spaced apart from the first arc side, each arc side comprising a first vertical edge, a second vertical edge, and a debris blocker component at the second vertical edge, where the debris blocker component is disposed proximate to the separable contacts and structured to collect debris generated during an interruption of the circuit interrupter and intercept the debris from entering into the operating mechanism area; and a plurality of arc plates disposed between the first arc side and the second arc side, the separable contacts disposed within the plurality of arc plates, each arc plate including a base proximate to the first vertical edge and two legs each extending from the base and comprising a distal element disposed away from the base and proximate to the separable contacts, where each arc plate is structured to attract and quench an arc generated upon opening of the separable contacts associated with the interruption and the distal element is structured to accelerate the opening of the separable contacts.

Another example embodiment includes an arc chute assembly for use in a circuit interrupter. The arc chute assembly a first arc side and a second arc side opposite and spaced apart from the first arc side, each arc side comprising a first vertical edge, a second vertical edge, and a debris blocker component at the second vertical edge, where the debris blocker component is disposed proximate to the separable contacts and structured to collect debris generated during an interruption of the circuit interrupter and intercept the debris from entering into the operating mechanism area; and a plurality of arc plates disposed between the first arc side and the second arc side, the separable contacts disposed within the plurality of arc plates, each arc plate including a base proximate to the first vertical edge and two legs each extending from the base and comprising a distal element disposed away from the base and proximate to the separable contacts, where each arc plate is structured to attract and quench an arc generated upon opening of the separable contacts associated with the interruption and the distal element is structured to accelerate the opening of the separable contacts.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
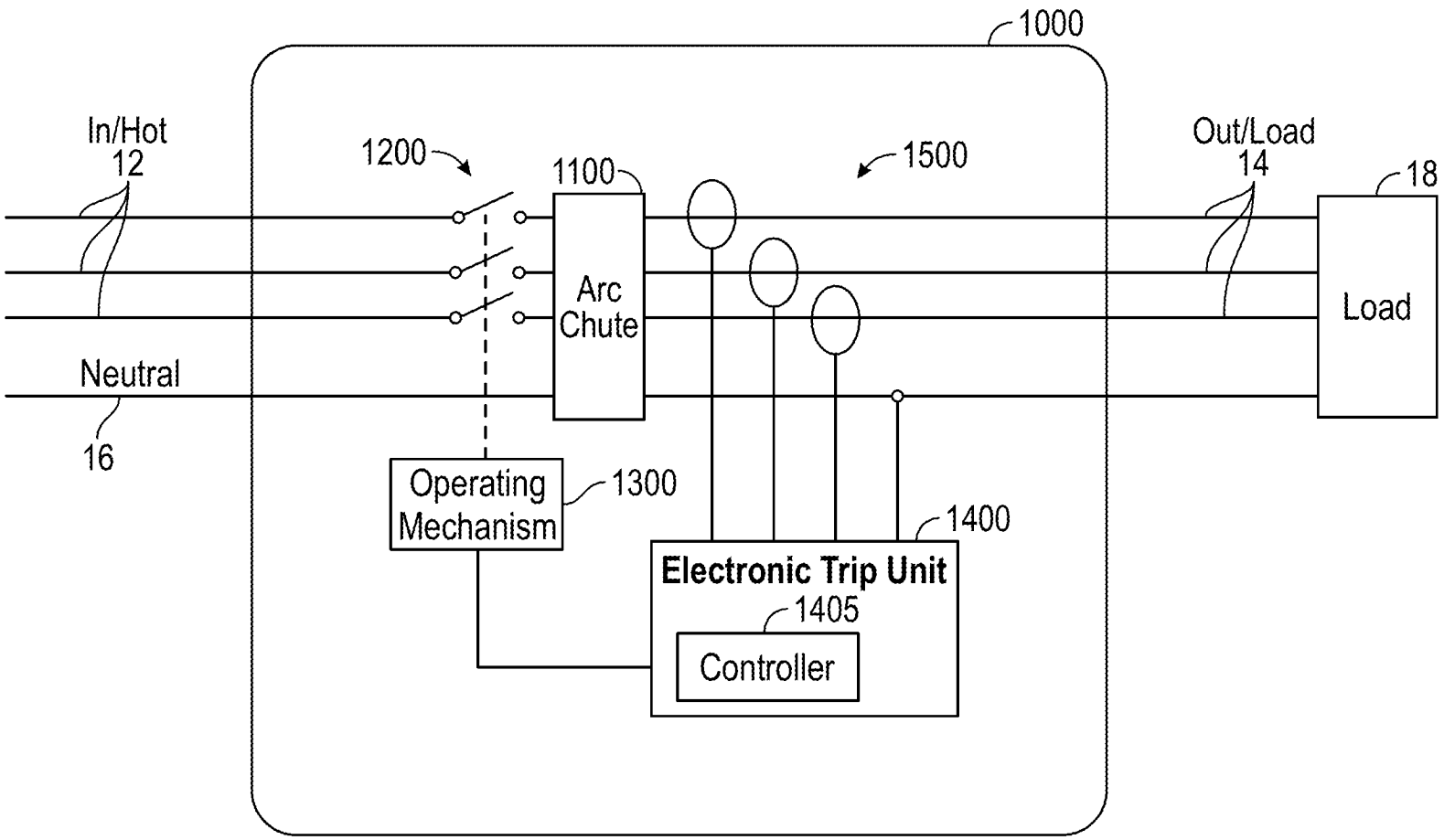
FIG. 1 is a schematic diagram of a circuit interrupter in accordance with an example embodiment of the disclosed concept.

Directional phrases used herein, such as, for example, left, right, front, back, top, bottom and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

Conventional circuit breakers include an arc chute assembly, a slot motor, and a debris blocker as separate components. However, the arc chute assemblies, debris blocker and slot motor are typically press-fit within the circuit breakers, requiring specific alignment, placement, and dimensional stability. For example, the slot motors are disposed in the bottom half portion of the circuit breakers while the arc plates of the arc chute assemblies are disposed in the top half portion of the circuit breakers with the slot motor being open on the top so as to allow the moving contact to pass the ends of the arc plates as it separates from the stationary contact during interruption. The arc sides, however, extend the full height of the circuit breakers to keep the arc plates in the desired position, but the bottom portion of the arc sides includes merely a void, wasting valuable spaces within the circuit breakers. Further, due to limited space available in the circuit breakers, only one conventional debris blocker may be included, typically in the pole nearest the operating mechanism area, thereby limiting the areas of debris blocking coverage. In addition, because these components are press-fit, an interruption may dislocate or disconnect one or more components out of their alignment or placement. Such dislocation or disconnection out of the alignment lead to generating undesired spaces between the components through which the debris may travel and enter the operating mechanism area. At individual level, each component may also suffer from less than optimal performance. For example, the conventional debris blocker typically includes two sidewalls that are merely flat surfaces. Thus, when an arc is generated, debris from erosion of arc chute components may bounce off these walls and be projected into the operating mechanism area of the circuit breaker, resulting in malfunctioning of the moving parts of the operating mechanism. Finally, having to add three separate devices each requiring their own parts and components can be costly.

Example embodiments of the disclosed concept address these issues. In some example embodiments, the arc chute assembly integrates the arc chute components, the slot motor and the debris blocker into a single device. For example, the arc chute assembly adds to its own components as either an extension of or attachment to these components to perform the same, in fact more enhanced, functionalities of the debris blocker and/or the slot motor. For example, the arc chute assembly integrates into its arc plates distal elements structured to induce a magnetic field to accelerate opening of the separable contacts in the event of a fault. The integration of the distal elements, thus, eliminates a need for a separate slot motor to be inserted within the circuit breaker, and thus, frees up the spaces within the circuit breakers that would have been occupied by the slot motor for enhanced debris blocking and accelerating the opening of the separable contacts. For instance, the arc plates, particularly the distal elements, extend into these freed spaces. Thus, the arc plates are now disposed over an area covering the full height of the circuit interrupter and twice the width as compared to that when a slot motor is inserted in the circuit breaker, thereby increasing the areas covered for arc quenching and inducing additional magnetic field for accelerating the contacts opening.

Further, the arc sides of the arc chute assembly integrate a debris blocking component proximate to the separable contacts and ends of the arc plates including the distal elements. The debris blocking component forms a debris pocket between its wall and the ends of the arc plates so as to collect debris generated as a result of the arc and prevent the debris from ever entering into the operating mechanism by trapping the debris within the debris pocket. In addition, the arc sides include a region for holding components (e.g., recess) structured to receive fixing components (e.g., protrusions, prongs) of the arc chutes so as to not only fasten and hold the arc plates in desired positions, but also to reduce any spaces between the arc sides and the arc plates.

As such, unlike the conventional debris blockers, the debris cannot bounce off the arc sides and escape into the operating mechanism area. Additionally, the debris blocker component is integrated in each arc chute assembly for each pole of the circuit breaker, thereby providing more coverage areas for the debris blocking and further enhancing debris blocking capability. As previously mentioned, the debris blocking component and the distal elements may be an extension of or an attachment staked onto the arc sides and the arc plates, respectively. As such, impact of the arc cannot dislocate or disconnect the debris blocker element and/or distal elements from the arc chute assembly, thereby providing increased structural integrity and preventing any creation of additional escape paths to the operating mechanism area by the debris as a result of the impact. Further, such extension of or attaching a simple wall or distal elements to already existing components of the arc chute assembly reduces manufacturing and design costs as compared to installing separate debris blocker and slot motor requiring separate parts and components in the circuit breaker.

Therefore, the arc chute assembly of the disclosed concept eliminates unnecessary costs and spaces required by press-fitting the conventional arc chute assembly, slot motor, and debris blocker as separate components, replaces and performs all functions of these components effectively as a single device, and significantly enhances debris blocking and magnetic field generating capabilities over these components.

FIG. 1 is a schematic diagram of a circuit interrupter 1000 (e.g., without limitation, a circuit breaker) in accordance with an example embodiment of the disclosed concept. The circuit interrupter 1000 is structured to be electrically connected between a power source (now shown) via HOT conductors 12 and a load(s) 18 via LOAD conductors 14. The circuit interrupter 1000 is structured to trip open or switch open to interrupt current flowing to the load 18, for example, in the case of a fault condition (e.g., without limitation, an overcurrent condition) to protect the load 18, circuitry associated with the load 18, as well as the components within the circuit interrupter 1000. While a 3-phase circuit breaker 1000 is shown in FIG. 1, it will be appreciated that a single-phase circuit breaker or any other number of phases may be employed without departing from the scope of the disclosed concept.

The circuit interrupter 1000 includes arc chute assemblies 1100, separable contacts 1200, an operating mechanism 1300, an electronic trip unit 1400, and a current sensor 1500. The operating mechanism 1300 is structured to physically open and close the separable contacts 1200. The electronic trip unit 1400 is structured to control the operating mechanism 1300 to open the separable contacts 1200 based on a signal including voltage measured at an output of the current sensor 1500. The electronic trip unit 1400 includes a controller 1405 structured to monitor for faults based on power flowing through the circuit breaker 1000 and output a trip signal to the operating mechanism 1300. For example, in a mechanical circuit interrupter, the separable contacts are designed to interrupt current flowing through the circuit interrupter and have associated components such as an arc chute to manage arcing as a result of circuit interruption. In some example embodiments, the separable contacts 1200 are closed with manual intervention by a user through, for example, a reset switch. In some example embodiments, the operating mechanism 1300 is structured to close the separable contacts 1200 in response to a close signal from the electronic trip unit 1400.

The arc chute assembly 1100 is disposed proximate to the separable contacts 1200 in order to attract an arc that is generated by the opening of the separable contacts 1200, e.g., without limitation, in response to an overload condition or short circuit condition of the circuit interrupter 1000. The arc chute assembly 1100 includes a first arc side (e.g., without limitation, a first arc side 3120 of FIG. 3), a second arc side (e.g., without limitation, a second arc side 3122 of FIG. 3) opposite and spaced apart from the first arc side, and a plurality of arc plates between the first and second arc sides. The first arc side and the second arc side are made of rigid materials (e.g., without limitation, plastic such as thermoset polyester) to hold the plurality of arc plates in desired place and withstand impact of interruption of the circuit breaker 1000. Each arc side includes a debris blocker component (e.g., without limitation, a debris blocker component 3130 of FIGS. 3, 4A-B and 5B) at a vertical edge. The debris blocker component is disposed proximate to the separable contacts 1200 and structured to collect debris generated during an interruption of the circuit interrupter 1000 and intercept the debris from entering into the operating mechanism area O (e.g., without limitation, operating mechanism area O of FIG. 6B). The arc chute assembly 1100 may be pressure-dropped within the circuit breaker 1000.

In some example embodiments, the plurality of arc plates are disposed between the first arc side and the second arc side, and the separable contacts 1200 are disposed within the plurality of arc plates. Each arc plate includes a base and two legs each extending substantially parallel to each other and away from the base. Each leg includes a distal element (e.g., without limitation, a distal element 3113 as shown in FIGS. 4B and 6B) disposed proximate to the separable contacts 1200. Each arc plate is structured to attract and quench an arc generated upon opening of the separable contacts 1200 associated with the interruption and the distal element is structured to accelerate the opening of the separable contacts 1200. Each arc plate may include a U-shape, a V-shape or any other appropriate shape for quenching the arc. The U-shape geometry, for example, results in the formation of an arc-induced magnetic field, which draws the arc into the arc chute assembly where it may be effectively split among the arc plates into a series of smaller arcs and dissipated until the electrical current of the arc is extinguished.

In some example embodiments, the debris blocker component includes a vertical wall (e.g., without limitation, a vertical wall 3132 of FIG. 5B) extending from the vertical edge of the respective arc side and around ends of respective legs of the plurality of arc plates towards the separable contacts 1200. The debris blocker component and the ends of the respective legs form a debris pocket (e.g., without limitation, a debris pocket 3133 of FIG. 5B) structured to contain the debris. Each arc plate includes a plurality of fixing elements (e.g., protrusions or prongs) and each arc side includes a region structured to receive and hold the fixing elements. In some examples, the prongs of the arc plates are covered with the debris blocker component. The vertical wall of the debris blocker component is disposed proximate to the ends of the respective legs and the separable contacts 1200 such that the arc travels through an arc plate into the debris pocket without being bounced off at least one of the respective arc side or the vertical wall of the debris blocker component. The debris blocker component may be an extension of the respective arc side or an attachment fixed onto the vertical edge of the respective arc side. The attachment may be fixed by, e.g., without limitation, being staked on the vertical edge of the respective arc side to ensure structural integrity that is capable of withstanding impacts of the arc or the interruption. Staking is a manufacturing process of forming one part into another by pressing it and forming an interference mating. It is a process comparable to riveting. No disconnection of the debris blocker component from the respective arc side occurs as a result of the interruption. For accelerating the opening the separable contacts, the distal element is structured to induce an additional magnetic field to help repel the separable contacts from each other based on the detected fault including a high current discharge of up to 25,000 Amps. The distal element eliminates a need for a separate slot motor 2140, and reduces dielectric breakdown of the slot motor 2140. The vertical wall of the debris blocker component provides insulation to prevent the attraction of the arc into the distal elements, providing a more efficient quenching.

Figure 2A:
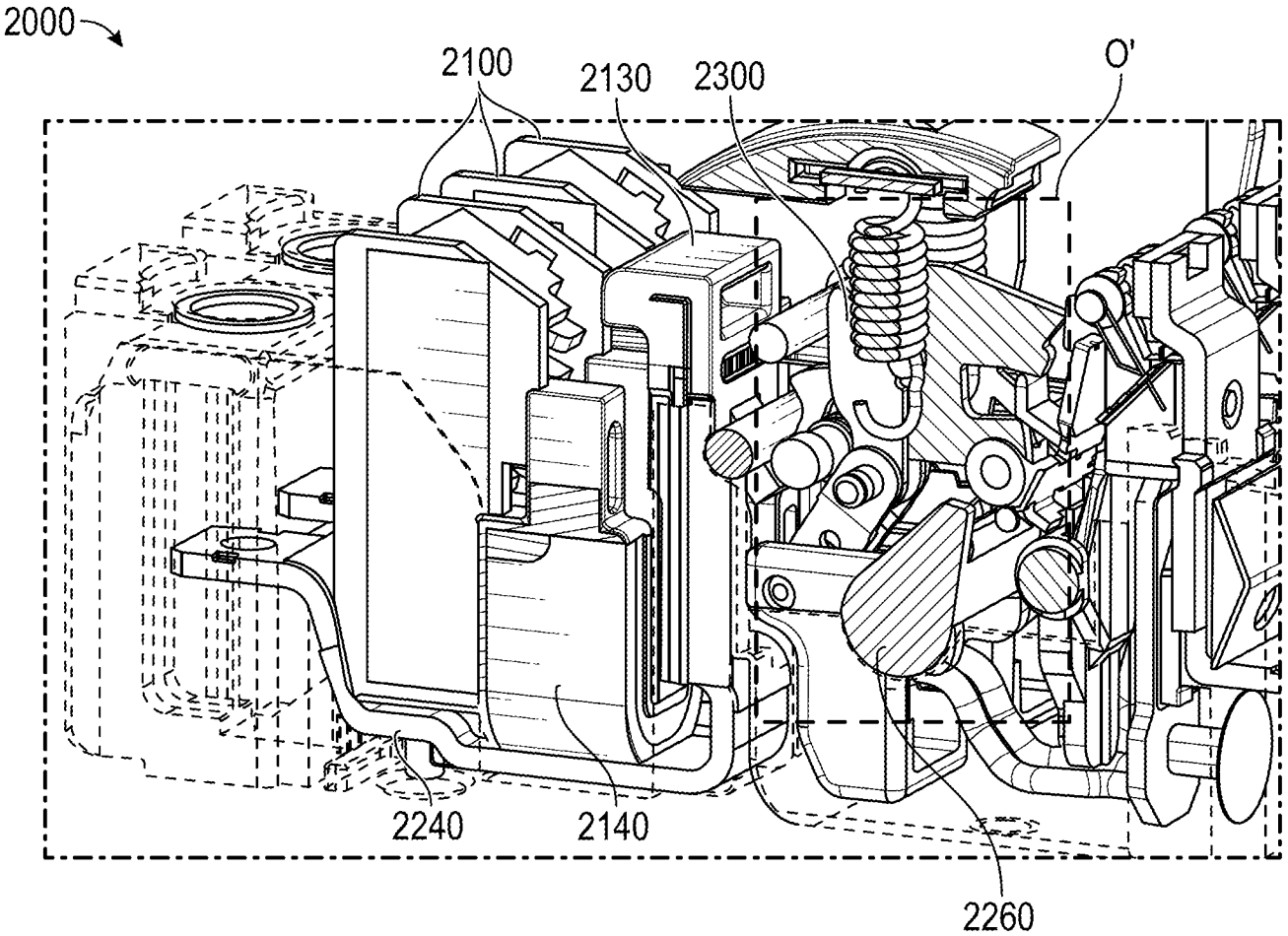
FIGS. 2A-B illustrate a conventional three-phase circuit breaker 1.
Figure 2B:
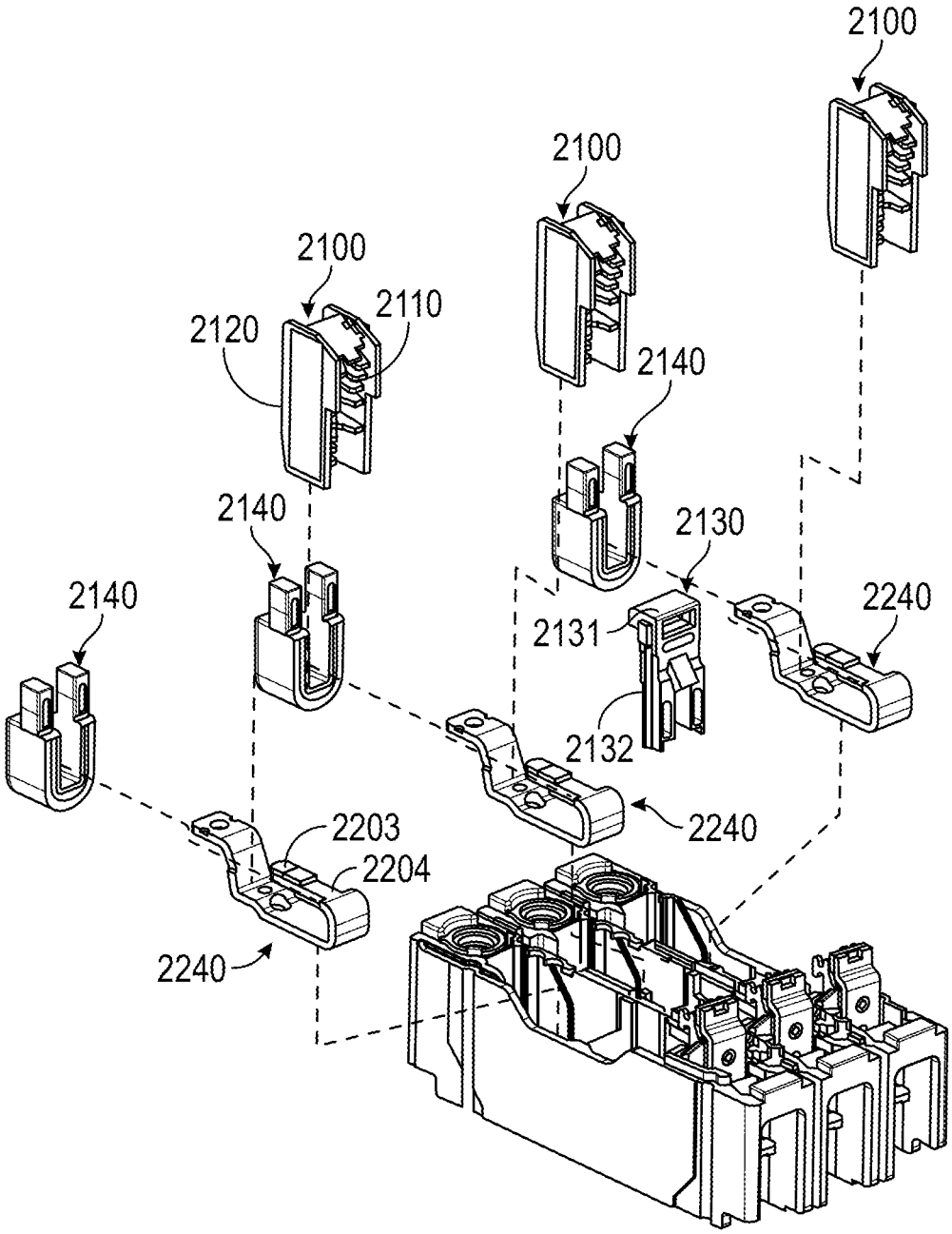

FIGS. 2A-B illustrate a conventional three-phase circuit breaker 2000. The conventional circuit breaker 2000 includes an arc chute assemblies 2100, a debris blocker 2130, and a slot motor 2140 as separate components that are press-fit inside the circuit breaker 2000. Since these components are held together with one another, they require alignment, placement and dimensional stability to provide arc suppression and debris containment as desired. For example, the slot motors 2140 are disposed in the bottom half portion of the circuit breaker 2000 while the arc plates 2110 of the arc chute assemblies 2100 are disposed in the top half portion of the circuit breaker 2000 with the slot motor 2140 being open on the top so as to allow the moving contact 2201 to pass the ends of the arc plates 2110 as it separates from the stationary contact 2202 during interruption. The arc sides 2120, however, extend the full height of the circuit breakers 2000 to keep the arc plates 2110 in the desired position, but the bottom portion of the arc sides 2100 merely includes a void, wasting valuable spaces within the circuit breakers 2000. Further, due to limited space available in the circuit breakers 2000, only one conventional debris blocker 2130 may be included, typically in the pole nearest the operating mechanism area O', thereby limiting the areas of debris blocking coverage. In some examples, the debris blocker 2130 may include a top 2131 and two side walls 2132 extending vertically from the ends of the top 2131. The two side walls 2132 include flat surfaces off which debris generated during interruption may bounce off and enter into the operating mechanism area O'. A detailed description of these components is provided in the background section, as such for economy of disclosure any further overlapping description of these components is omitted.

Figure 3:
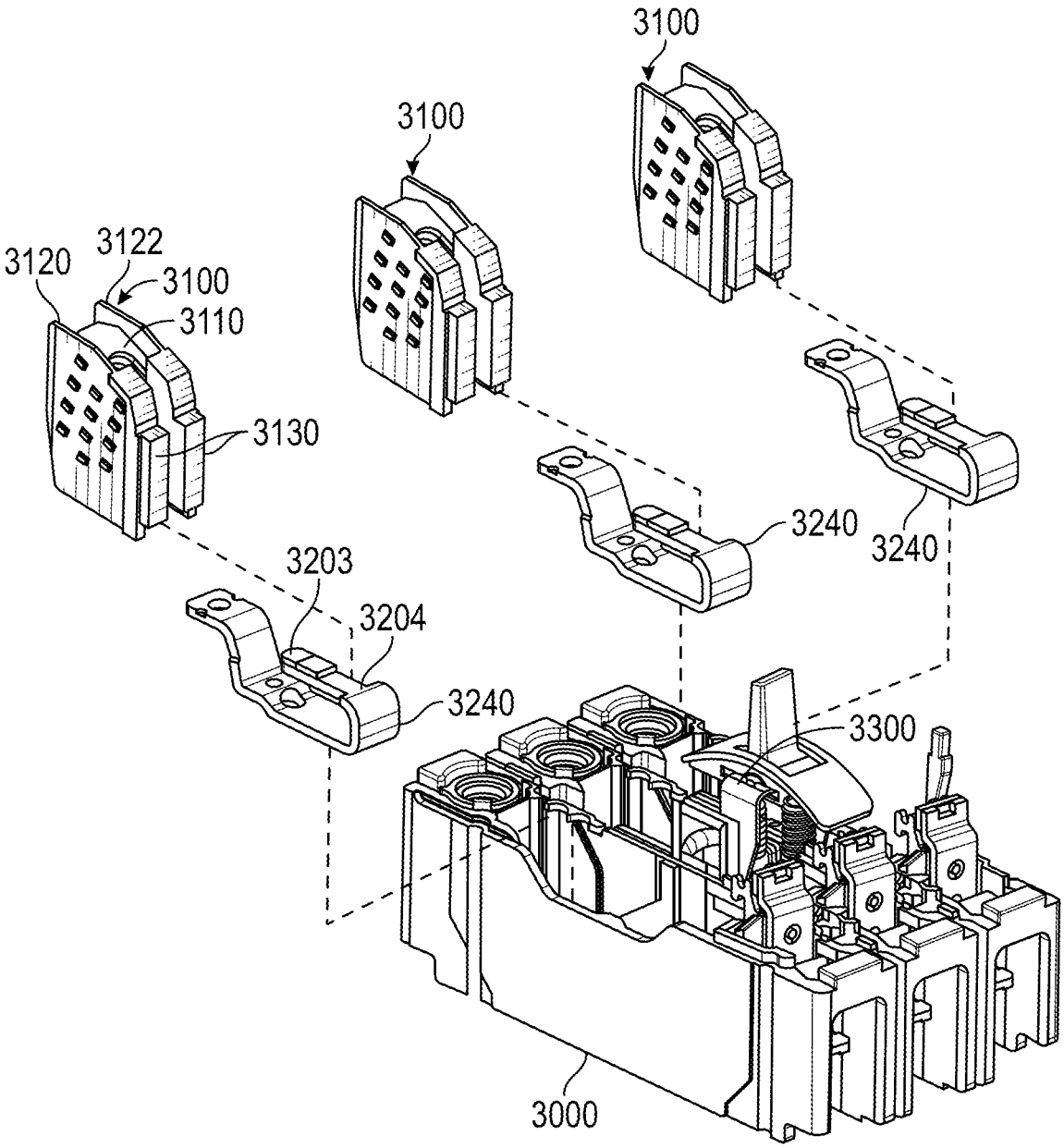
FIG. 3 is an exploded view of devices disposed in a circuit breaker according to an example embodiment of the disclosed concept.

FIG. 3 is an exploded view of devices disposed in a three-phase circuit breaker 3000 according to an example embodiment of the disclosed concept. The circuit breaker 3000 includes an arc chute assembly 3100 including a first arc side 3120, a second arc side 3122, and a plurality of arc plates 3110. The circuit breaker 3000 also includes a reverse loop 3240 including the stationary contact 3203 and stationary arm 3204, an operating mechanism 3300, and other components (e.g., a cross bar 3310). The first arc side 3120 and the second arc side 3122 each includes a debris blocker component 3130 at a vertical edge. The arc chute assembly 3100 is disposed proximate to the separable contacts 3200 in order to attract an arc that is generated by the opening of the separable contacts 3200, e.g., without limitation, in response to an overload condition or short circuit condition of the circuit interrupter 3000. Exemplary alignments for the arc sides 3120,3122, arc plates 3210, and the debris blocker 3130 are described further in detail with reference to FIGS. 4A-B, 5B, and 6A-B.

Figure 4A:
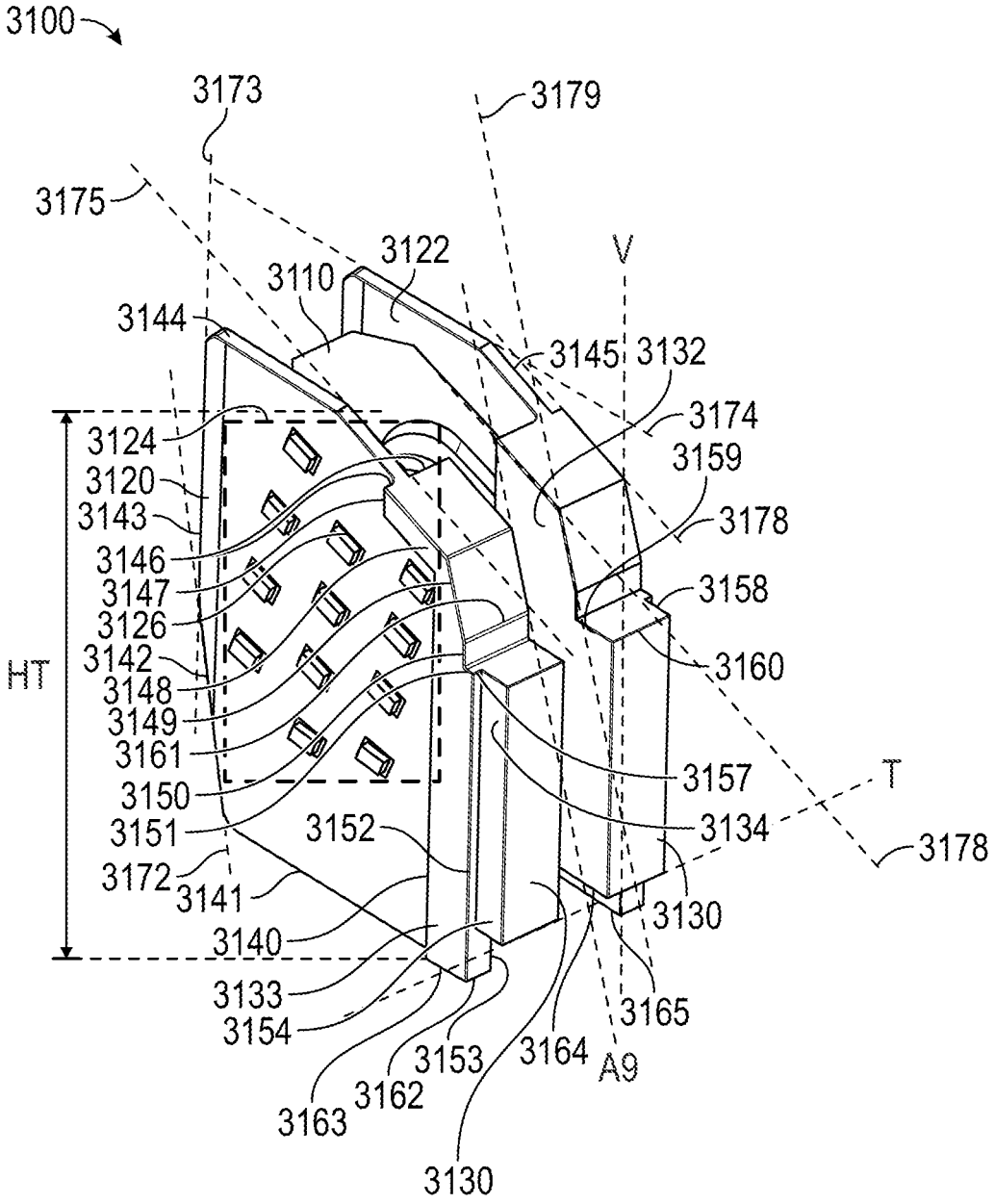
FIGS. 4A-C illustrate an arc chute assembly according to an example embodiment of the disclosed concept.
Figure 4B:
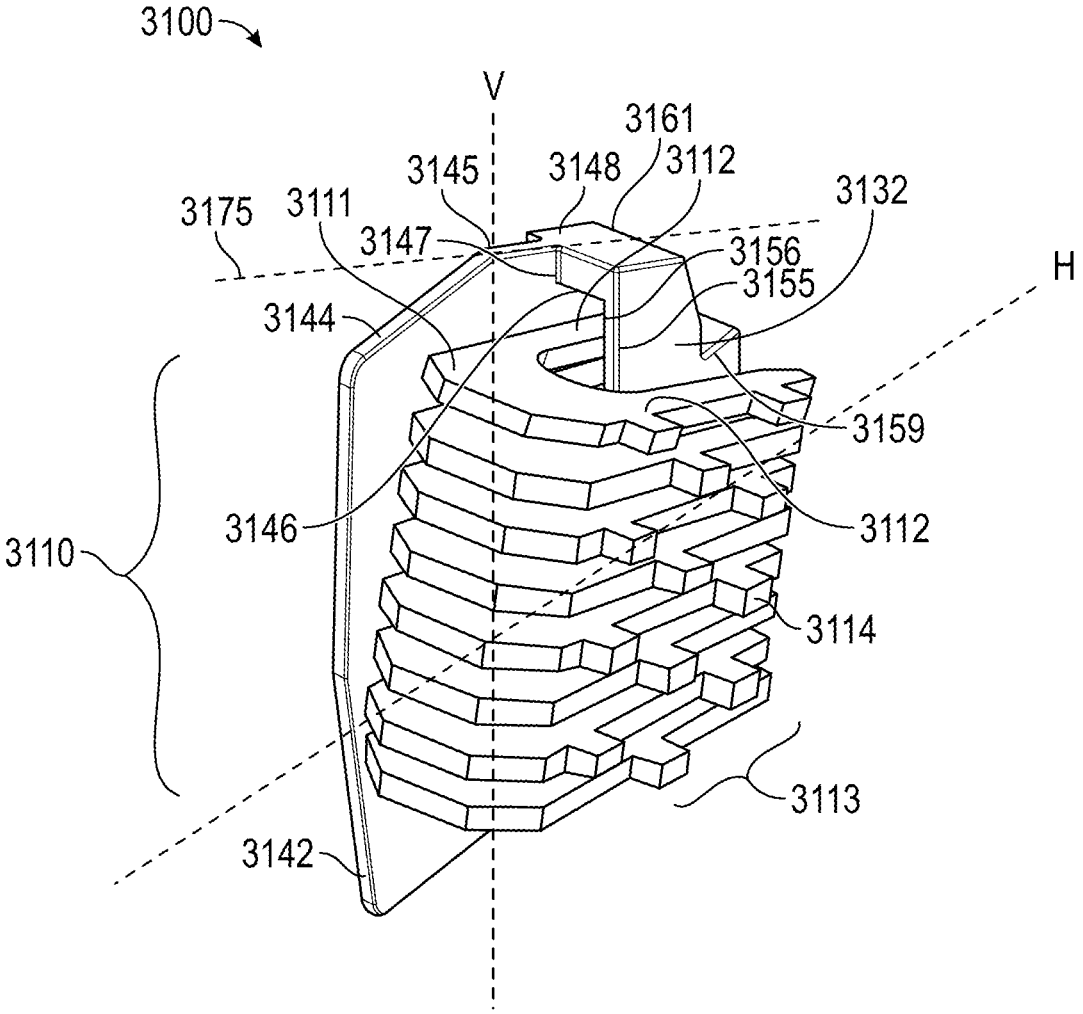
Figure 4C:
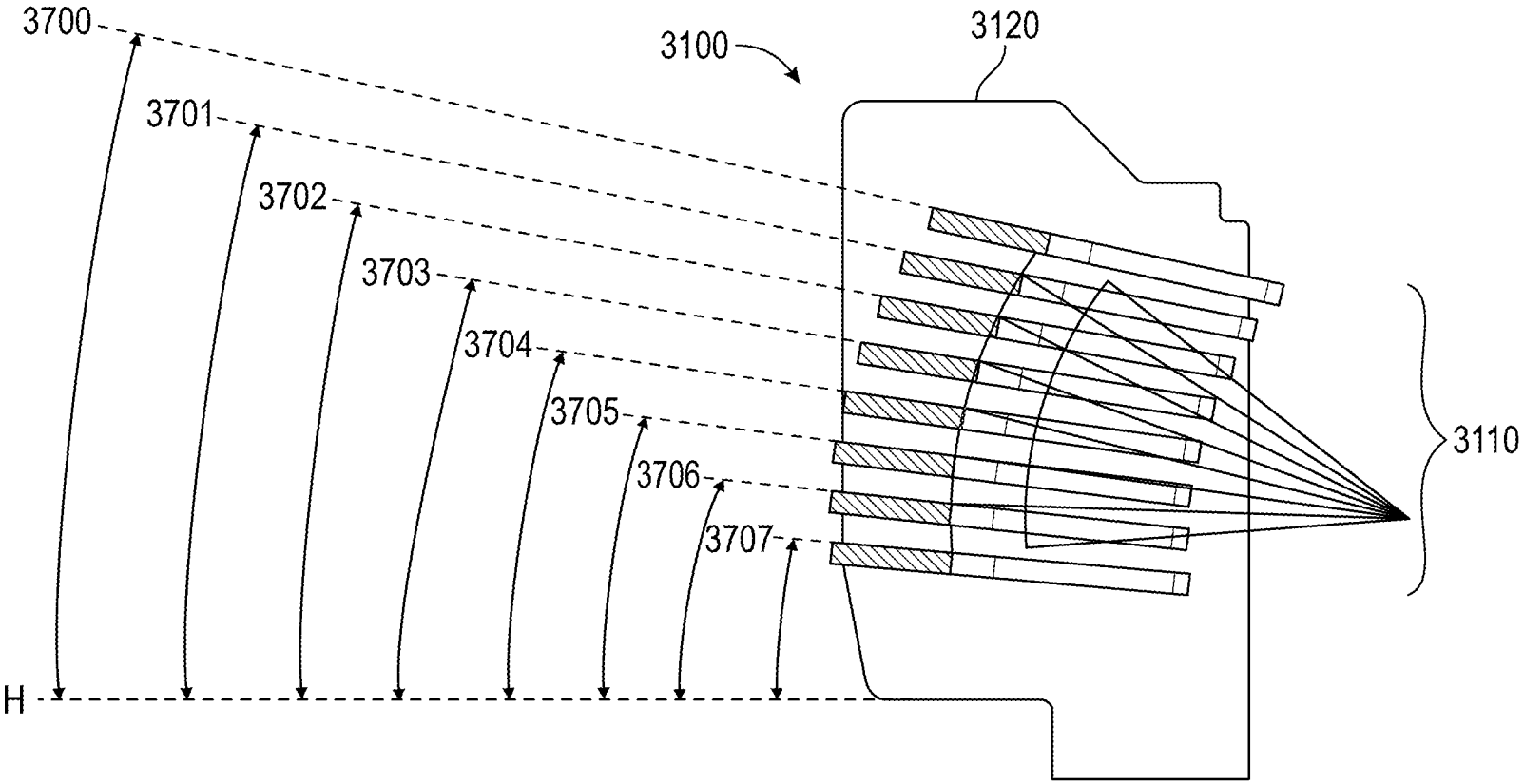

FIGS. 4A-C illustrate an arc chute assembly 3100 according to an example embodiment of the disclosed concept. FIG. 4A is a perspective view of a fully assembled arc chute assembly 3100, FIG. 4B is a perspective inner view of the fully assembled arc chute assembly 3100, and FIG. 4C is a perspective view of an example arc plates disposition. The arch chute assembly 3100 includes a first arc side 3120, a second arc side 3122 opposite and spaced apart from the first arc side 3120, and a plurality of arc plates 3110 between the first and second arc sides 3120, 3122. Each arc side 3120, 3122 has a first vertical edge 3140, second vertical edges 3142, 3143 proximate to the bases 3111 of the arc plates 3110, top longitudinal edges 3144, 3145, 3148 and a bottom longitudinal edge 3141. The first vertical edge 3140 runs parallel to the vertical axis V and the bottom longitudinal edge 3141 runs parallel to the horizontal axis H. The second vertical edges 3142, 3143 run parallel to axes 3172, 3173 approximately at angles 11° and 0° from the vertical axis V, respectively. The top longitudinal edges 3144, 3145, 3148 run parallel to the axes 3174, 3175, 3178.

Figure 5B:
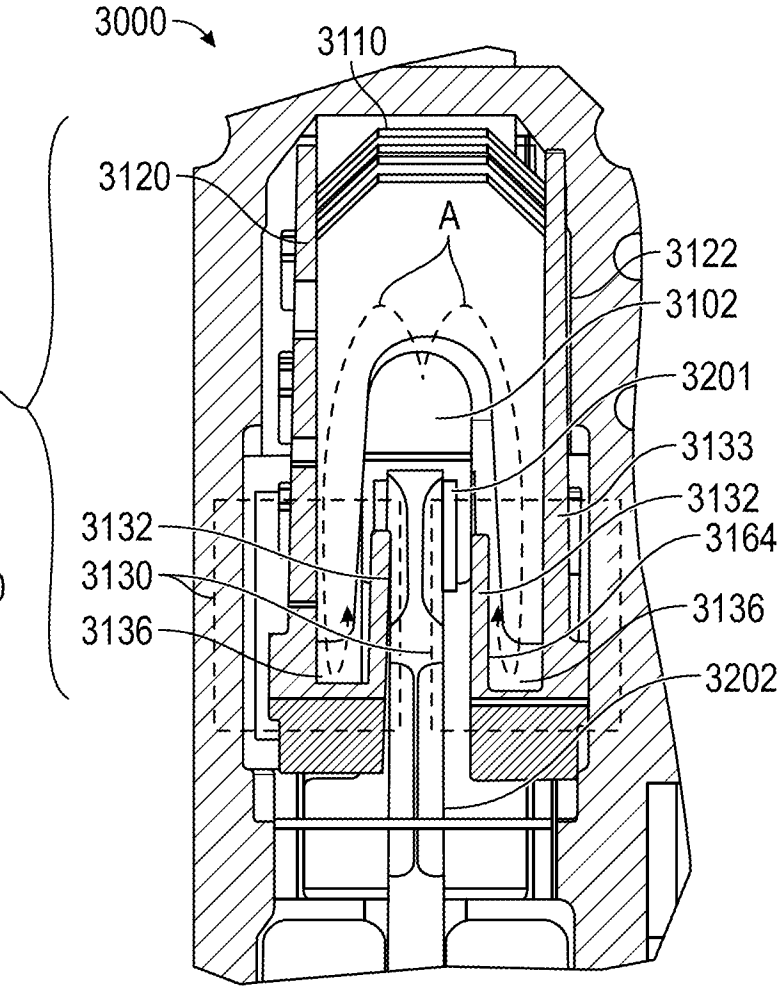
FIGS. 5A-B illustrate plan views of debris paths in a circuit breaker according to an example embodiment of the disclosed concept.

The debris blocker component 3130 is integrated with each arc side 3120, 3122 at the first vertical edge 3140. The debris blocker component 3130 may be an extension of the arc sides 3120, 3122 or an attachment molded onto the first vertical edge 3140 of the arc sides 3120, 3122. For example, the extension of the arc sides 3120, 3122 may include a simple extension of the side arc from the first vertical edge 3140 in the shape of the debris blocker component 3130 in one piece. The attachment includes the debris blocker component 3130 simply, e.g., without limitation, molded onto the first vertical edge 3140. The debris blocker component 3130 has one or more vertical walls 3132, 3133, 3134 running parallel to one another. One 3133 of the vertical walls extends from or attached to the vertical edge 3140 of the arc side 3120, 3122. Another wall 3132 extends towards the separable contacts 3200. There may be another vertical wall 3134 added to taper in debris pockets 3136 the ends of the debris blocker components 3130. The vertical walls have the vertical edges 3140, 3150, 3152, 3153, 3154, 3155, 3156, 3147, top longitudinal edges 3148, 3149, 3151, 3158, 3159 and bottom longitudinal edges 3163, 3164, 3165. The vertical edges 3140, 3150, 3152, 3153, 3154, 3155, 3156, 3147 run parallel to the vertical axis V. The top longitudinal edges 3148 and 3149 run parallel to axes 3178 and 3179, respectively. The top longitudinal edges 3151, 3158, 3159 and bottom longitudinal edges 3163, 3164, 3165 run parallel to the horizontal axis H. These edges are connected to transverse edges 3146, 3151, 3160, 3162 so as to form transverse surfaces. The transverse surfaces and the vertical walls 3132, 3133, 3134 together form U-shaped debris blocker component 3130 as shown in FIGS. 4A-B and 5B. The vertical wall 3134 may be connected to the vertical walls 3132, 3133 and transverse edges 3151, 3161 to make the ends of the debris pockets 3136 narrower so as to ensure trapping of the debris within the debris pocket 3136.

The debris blocker component 3130 is structured to collect debris generated during the interruption of the circuit breaker 3000 and intercept the debris from entering into the operating mechanism area O (as shown in FIG. 6B) by trapping the debris within the debris pocket 3136. It is noted that while FIGS. 3-4B, 5B and 6A-B have specific alignments, edges, surfaces, walls, angles, etc., this is for illustrative purposes only and may include different alignments or components. For example, the circuit breaker 3000 may include a single vertical wall that is either extended from or attached to the vertical edge 3140 of respective arc side

3120, 3122. The single wall may then extend or pass around the ends of respective legs 3112 of the arc plates 3110.

Further, the first and second arc sides 3120, 3122 include a holding region 3124. The holding region 3124 includes a plurality of molded recesses 3126 structured to receive fixing portions 3114 of corresponding legs 3112 adjacent to the respective arc side 3120, 3122 in order to hold the arc plates 3110 in the desired orientation during the normal operation and interruption of the circuit breaker 3000.

The plurality of arc plates 3110 are disposed between the first arc side 3120 and the second arc side 3122, and the separable contacts 3200 are disposed within the plurality of arc plates 3110. Each arc plate 3110 includes a base 3111 and two legs 3112 each extending substantially parallel to each other and away from the base 3111. Each leg 3112 includes a distal element 3113 disposed proximate to the separable contacts 3200. As shown in FIG. 4C, the arc plates 3110 are equally spaced from one another and disposed in planes running parallel to axes 3700, 3701, 3702, 3703, 3704, 3705, 3706, and 3707 at 12 degrees, 11 degrees, 10 degrees, 9 degrees, 8 degrees, 7 degrees, 6 degrees, and 5 degrees, respectively, from the horizontal axis H. The angular dispositions of the arc plates shown in FIG. 4C are for illustrative purposes only, and any suitable angular dispositions may be utilized without departing from the scope of the disclosed concept. The plurality of arc plates 3110 extend vertically over the entire height HT of the arc chute assembly 3100. The arc plates 3110 are structured to attract and quench one or more arcs generated upon opening of the separable contacts 3200 associated with the interruption. Further, in order to enhance magnetic sensitivity, the arc plates 3110 integrate a distal element 3113 in each leg 3112 and disposed proximate to the separable contacts 3200. The distal element 3113 is structured to accelerate the opening of the separable contacts 3200 by inducing additional magnetic fields, which in turn assist with repelling the separation of the separable contacts 3200 from each other. The distal element 3113 extends into the area in which a slot motor 2140 would typically be disposed. As such, the distal elements 3113 generate even more magnetic fields covering at least twice the vertical area (as the arc plates 3110 cover the entire height HT of the arc chute assembly 3100) and the longitudinal area (as the distal element 3113 extends into the typical slot motor area) as does the conventional slot motor 2140. As a result, the distal elements 3113 accelerate the separation of the separable contacts 3200 much faster (e.g., at least twice as fast) than the conventional slot motor 2140 does. Such faster acceleration results in faster, and thus, more efficient protection of the load 18 and the circuit breaker 3000. This is particularly important in an event of fault involving a high current discharge, e.g., without limitation, up to 2,500 kA. The timely interruption of the power supply at the detection of such high current surge is crucial in protecting the power supply system and critical loads (e.g., without limitation, the IT servers). The example arc plates 3110 in FIG. 4B are U-shaped, however, it will be understood that the arc plates 3110 may have any other shape suitable (e.g., a V-shape, a ring-shape, etc.) for quenching arcs. While FIG. 4B shows eight U-shaped arc plates 3110, it will be appreciated that any known or suitable alternative number and/or configuration of arc plates could be employed, without departing from the scope of the disclosed concept. For example and without limitation, a plurality of V-shaped arc plates could be employed side-by-side. A plurality of conventional arc plates (not shown) could also be employed in combination with the disclosed arc plates 3110.

Figure 5A:
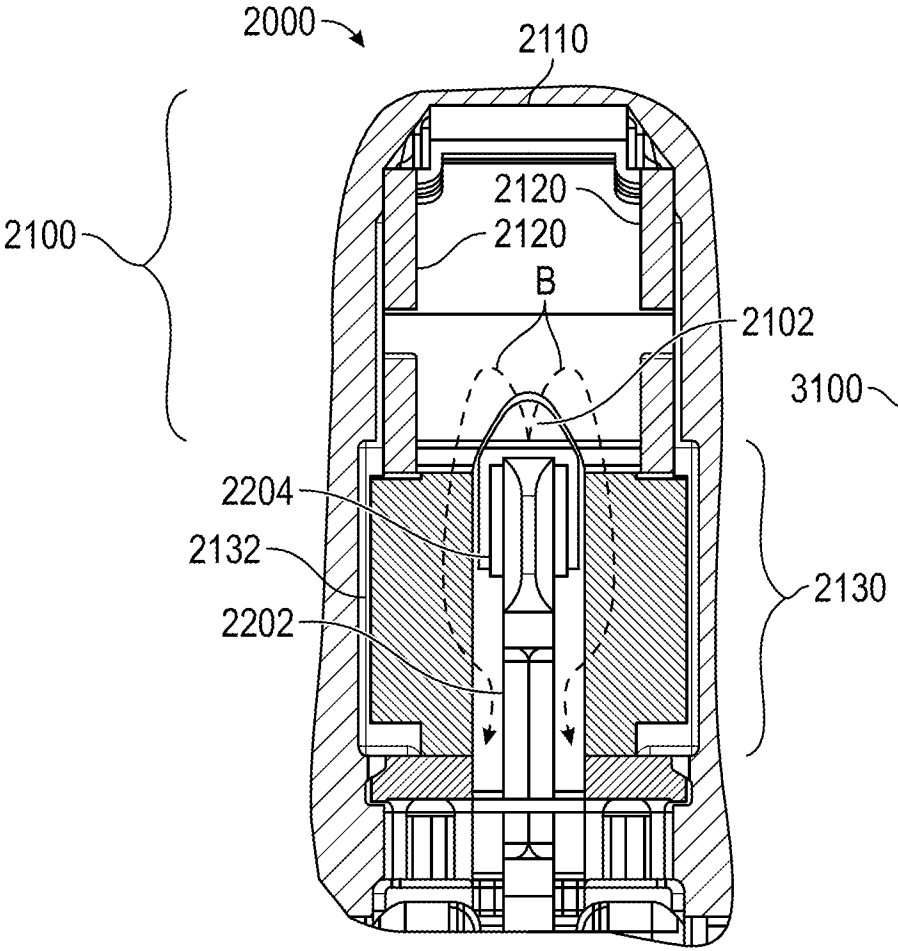

FIGS. 5A-B illustrate plan views of circuit breakers 2000, 3000 according to example embodiments of the disclosed concept, respectively. Description of the components of the circuit breakers 2000, 3000 in FIGS. 5A-B has been provided with reference to FIGS. 1-4B, and thus, for the economy of disclosure overlapping disclosure is omitted. FIG. 5A shows a conventional circuit breaker 2000 including a conventional arc chute assembly 2100 and debris blocker 2130 and a moving arm 2202 including a movable contact 2200. Debris path B shown in FIG. 5A indicates that debris that occurs from erosion of the arc chute assemblies 2100 bounces off the side walls 2132 of the debris blocker 2130 and eventually makes its way into the operation mechanism area O' via the spaces between the moving arm 2202 and the debris blocker 2130. As such, the conventional debris blockers 2130 do not have an efficient contain-and-hold mechanism, e.g., without limitation, the debris pockets 3136 of FIG. 5B. FIG. 5B shows a circuit breaker 3000 including an arc chute assembly 3100 and a moving arm 3202 including a movable contact 3201. The debris blocker component 3130 has inner walls (e.g., without limitation, the vertical wall 3132 as shown in FIG. 5B) running parallel to the first and second arc sides 3120, 3122 and connected to the arc sides 3120, 3122 via the transverse surfaces. The arc sides 3120, 3122, the transverse surfaces and the vertical walls 3132, 3133, 3134 form debris pockets 3136. Debris path A shown in FIG. 5B indicates that the debris formed during interruption is indeed contained within the debris pockets 3136. In fact, there is simply no spaces or walls within the debris blocker component 3130 that the debris can go around or bounce off into the operating mechanism area O. Thus, the debris are effectively prevented from escaping into the operating mechanism area O.

Figure 6A:
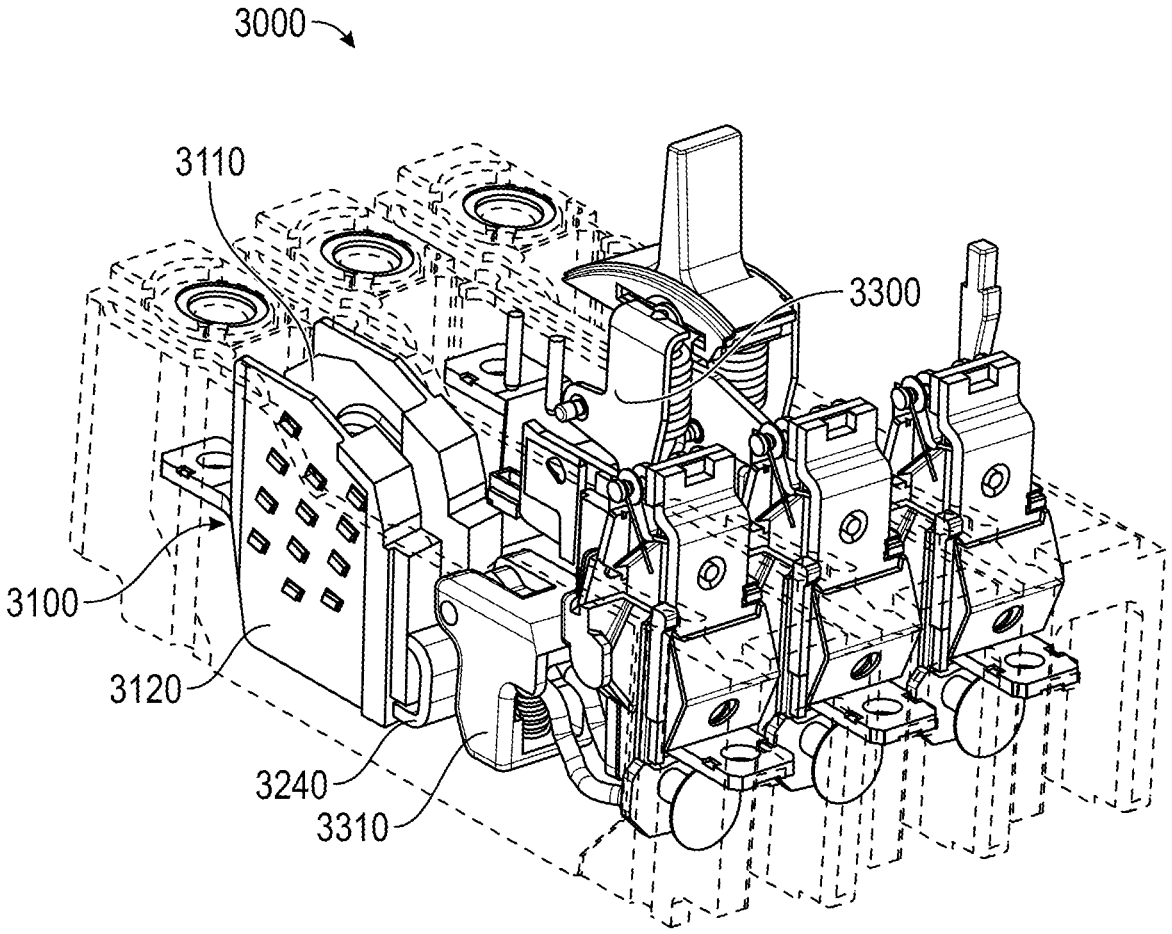
FIGS. 6A-B illustrate a circuit interrupter according to an example embodiment of the disclosed concept.
Figure 6B:
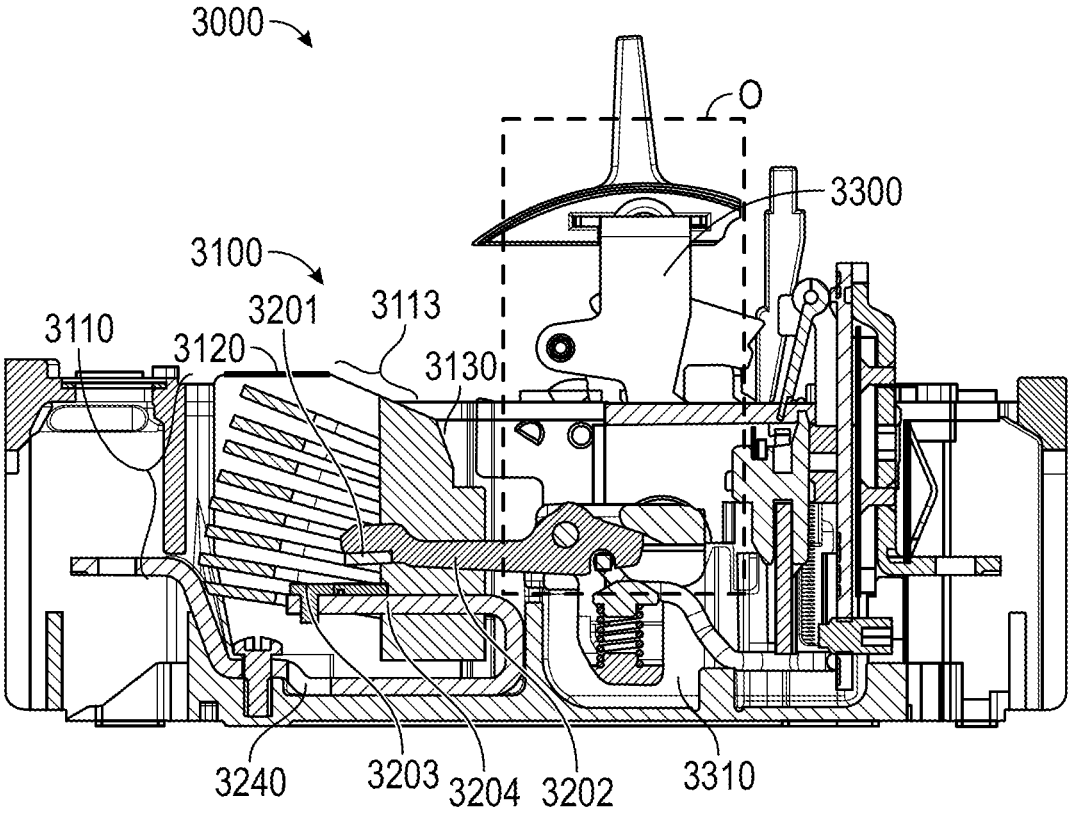

FIGS. 6A-B illustrate inside views of a circuit breaker 3000 according to example embodiments of the disclosed concept. FIG. 6A is an isometric view of the circuit breaker 3000 and FIG. 6B is a side section view of the circuit breaker 3000. The circuit breaker 3000 includes an arc chute assembly 3100 with arc plates 3110 and arc sides 3120, 3122, a reverse loop 3240, an operating mechanism 3300 in the operating mechanism area O, a cross bar 3310, etc. These components are the same as the components shown and/or described with reference to FIGS. 3A-4B and 5B, and thus, any overlapping description is omitted for the economy of disclosure. FIGS. 6A-B show the arc chute assembly 3100 fully assembled within the circuit breaker 3000, and show the arc chute assembly 3100 incorporating the capabilities of arc quenching, magnetic enhancement, and debris blocking all in one single device. This arc chute assembly 3100 removes the need to install separate slot motors 2140 or debris blockers 2130 within the limited space within the circuit breaker 3000. Further, the arc chute assembly 3100 is more compact and includes components that are more securely aligned together (e.g., without limitation, by being melt together) than the conventional three-separate-components (the arc chute, slot motor and debris blocker) are. Such compact design and improved structural integrity allows the arc chute assembly 3100 to be incorporated by a simple pressure drop within the circuit interrupters. As such, the arc chute assembly 3100 may be used with any commercially available circuit interrupters.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of disclosed concept which is to be given the full breadth of the claims appended and any and all equivalents thereof.

What is claimed is:

1. A circuit breaker structured to electrically connect between a power source coupled to a hot conductor and a load, the circuit breaker comprising:

(a) separable contacts;

(b) an operating mechanism coupled to the separable contacts and structured to open and close the separable contacts; and (c) an arc chute assembly disposed around the separable contacts, the arc chute assembly comprising:

(i) a first arc side and a second arc side opposite and spaced apart from the first arc side, each arc side comprising a debris blocker component extending from a vertical edge of each arc side, wherein the debris blocker component is disposed proximate to the separable contacts and structured to collect debris generated during an interruption of the circuit breaker and intercept the debris from entering into an area of the operating mechanism, the debris blocker component comprising a top transverse surface extending inwardly towards the separable contacts from a portion of a top edge of respective arc side and a wall extending downwardly from the top transverse surface such as to form a U-shaped debris pocket at the vertical edge; and (ii) a plurality of arc plates disposed between the first arc side and the second arc side, the separable contacts disposed within the plurality of arc plates, each arc plate comprising a base and two legs each extending from the base and comprising distal elements that are integrated as attachments to respective legs and disposed within respective debris blockers, distal elements structured to accelerate opening of the separable contacts, wherein each arc plate is structured to attract and quench an arc generated upon the opening of the separable contacts associated with the interruption such that the integration of the distal elements eliminates a need for a separate slot motor to be inserted within the circuit breaker.

2. The circuit breaker of claim 1, wherein the debris blocker component comprises a wall extending towards the separable contacts from the vertical edge of respective arc side and around ends of respective legs of the plurality of arc plates.

3. The circuit breaker of claim 2, wherein the debris blocker component and the ends of the respective legs form a debris pocket structured to contain the debris.

4. The circuit breaker of claim 2, wherein each leg of the arc plates comprises a plurality of fixing elements including protrusions and each arc side comprises a region structured to receive and hold the fixing elements.

5. The circuit breaker of claim 4, wherein the wall of the debris blocker component is disposed proximate to the ends of the respective legs and the separable contacts such that the arc travels through an arc plate into the debris pocket without being bounced off at least one of the respective arc side or the wall of the debris blocker component.

6. The circuit breaker of claim 5, wherein the wall of the debris blocker component provides insulation to prevent attraction of the arc into the distal elements.

7. The circuit breaker of claim 2, wherein the debris blocker component comprises one of a U-shape or V-shape.

8. The circuit breaker of claim 1, wherein distal elements of the plurality of arc plates being proximate to the separable contacts and ranging an entire height of the arc chute assembly are structured to assist with repelling the separable contacts from each other and accelerate the opening of the separable contacts.

9. The circuit breaker of claim 1, wherein the first arc side and the second arc side are composed of plastic.

10. The circuit breaker of claim 1, wherein the plurality of arc plates are equally spaced apart from one another and stacked throughout the vertical height of the arc chute assembly.

11. An arc chute assembly for use in a circuit breaker, the arc chute assembly comprising:

(a) a first arc side and a second arc side opposite and spaced apart from the first arc side, each arc side comprising a debris blocker component extending from a vertical edge of each arc side, wherein the debris blocker component is disposed proximate to separable contacts of the circuit breaker and structured to collect debris generated during an interruption of the circuit breaker and intercept the debris from entering into an operating mechanism area of the circuit breaker, the debris blocker component comprising a top transverse surface extending inwardly towards the separable contacts from a portion of a top edge of respective arc side and a wall extending downwardly from the top transverse surface such as to form a U-shaped debris pocket at the vertical edge; and (b) a plurality of arc plates disposed between the first arc side and the second arc side, the separable contacts disposed within the plurality of arc plates, each arc plate comprising a base and two legs each extending from the base and comprising distal elements that are integrated as attachments to respective legs and disposed within respective debris blockers, the distal elements structured to accelerate opening of the separable contacts, wherein each arc plate is structured to attract and quench an arc generated upon opening of the separable contacts associated with the interruption such that the integration of the distal elements eliminates a need for a separate slot motor to be inserted within the circuit breaker.

12. The arc chute assembly of claim 11, wherein the debris blocker component comprises a wall extending towards the separable contacts from the vertical edge of respective arc side and around ends of respective legs of the arc plates.

13. The arc chute assembly of claim 12, wherein the debris blocker component and the ends of the respective legs form debris pockets structured to contain the debris.

14. The arc chute assembly of claim 11, wherein distal elements of the plurality of arc plates are disposed proximate to more than one half of a moving arm of a movable contact and extend an entire height of the arc chute assembly, such that the distal elements structured to assist with repelling the separable contacts from each other and accelerate the opening of the separable contacts.

* * * * *